United States Patent [19]

Getz et al.

[11] Patent Number: 4,528,709

[45] Date of Patent: Jul. 16, 1985

[54] AUTOMATIC TEMPERATURE CONTROL FOR AUTOMATIC WASHERS

[75] Inventors: Edward H. Getz, Pipestone Township, Berrien County; Donald E. Knoop, Royalton Township, Berrien County, both of Mich.

[73] Assignee: Whirlpool Corporation, Benton Harbon, Mich.

[21] Appl. No.: 558,840

[22] Filed: Dec. 7, 1983

[51] Int. Cl.[3] ..... D06F 33/02; D06F 39/08

[52] U.S. Cl. ..... 8/158; 68/12 R; 68/207; 236/12.12; 364/172; 364/400

[58] Field of Search ..... 8/158; 68/12 R, 207; 137/3, 88; 236/12.1, 12.11, 12.12, 12.15; 364/400, 172, 173

[56] References Cited

U.S. PATENT DOCUMENTS

| | | | |
|---|---|---|---|
| 3,383,037 | 5/1968 | Vince | 236/12.12 |
| 3,434,488 | 3/1969 | Talbot | 236/12.12 |
| 3,477,258 | 11/1969 | Walker et al. | 68/12 R |
| 3,487,996 | 1/1970 | Lofgren | 236/12.12 |
| 3,707,857 | 1/1973 | Wigfall | 68/12 R |
| 4,147,297 | 4/1979 | Worst | 68/12 R X |
| 4,330,081 | 5/1982 | McMillan | 68/12 R X |
| 4,359,186 | 11/1982 | Kiendl | 137/88 X |
| 4,406,401 | 9/1983 | Nettro | 68/12 R X |

*Primary Examiner*—Philip R. Coe

*Attorney, Agent, or Firm*—Hill, Van Santen, Steadman & Simpson

[57] ABSTRACT

An automatic temperature control for automatic washers is provided which minimizes the cycling of the water inlet valves to a maximum of two cycles each during the fill process. A predetermined volume of water from a first inlet line is admitted for measuring the temperature and flow rate and then that flow is terminated while a second predetermined volume of water from a second inlet line is admitted for measuring that temperature and flow rate. Then the amount of each of the two inlet streams is calculated so that a final preselected water level will be attained at a preselected temperature.

7 Claims, 4 Drawing Figures

AUTOMATIC TEMPERATURE CONTROL FOR AUTOMATIC WASHERS

BACKGROUND OF THE INVENTION

1. Field of the Invention

This invention relates to an automatic temperature control for a clothes washing machine.

2. Description of the Prior Art

Various methods and devices have been proposed in the past for controlling the temperature of the liquid added to a clothes washing machine to arrive at a final desired temperature of the wash fluid.

U.S. Pat. No. 3,707,857 discloses an automatic washer that utilizes a temperature sensor for controlling the water inlet valves to produce the desired temperature in the wash bath.

U.S. Pat. No. 4,330,081 provides a water temperature control system for a clothes washing machine in which the temperature of the incoming mixed hot and cold water is periodically sensed, and the accumulated average temperature of the mixed water is compared to a desired temperature value stored in the memory of a microprocessor. When the comparison results in a temperature difference which exceeds a predetermined error limit, the appropriate hot and/or cold water valves are turned off or on causing the average temperature of the mixed water to change toward the desired temperature value.

U.S. Pat. No. 4,147,297 discloses a temperature sensing system for controlling the temperature of fill water in an automatic washer in which the user may select one of two temperature levels and the control system will fill the washer with water at a temperature at or below the selected temperature. The inlet hot water valve is continuously held open during the fill process and the cold water valve is opened only when the hot water temperature is above the selected temperature level.

The prior art devices and methods have a drawback in that they do not provide a precise final temperature of the wash bath with a minimum number of cycles of the inlet control valves. The wash bath provided is either of a temperature not necessarily that selected by the user, or else there is excessive cycling of the inlet valves with the attendant wear thereof.

SUMMARY OF THE INVENTION

The present invention provides a wash bath temperature control which senses the temperature and flow rate of the hot and cold water inlets separately and from this data the quantity of hot and cold water necessary to arrive at the desired temperature at the selected water level is determined. A steady state temperature and flow rate for each of the inlets is measured by alternately opening and closing the valves of each inlet. Once these values are attained, the proportion of each water supply that should be added to the tub is calculated and the valves are then opened and closed at the appropriate times. In this manner, each of the inlet control valves is cycled a maximum of two times during the fill process.

If the hot water inlet temperature is below that of the selected temperature, then the cold water inlet valve will be cycled only once, the tub being filled with only the hot water after the initial temperature sensing fill. Likewise, if the selected temperature is below the temperature of the cold water inlet, the hot water inlet valve will be cycled only once. In this manner, unnecessary cycling of the control valves is avoided.

DESCRIPTION OF THE PREFERRED EMBODIMENTS

Figure 1:
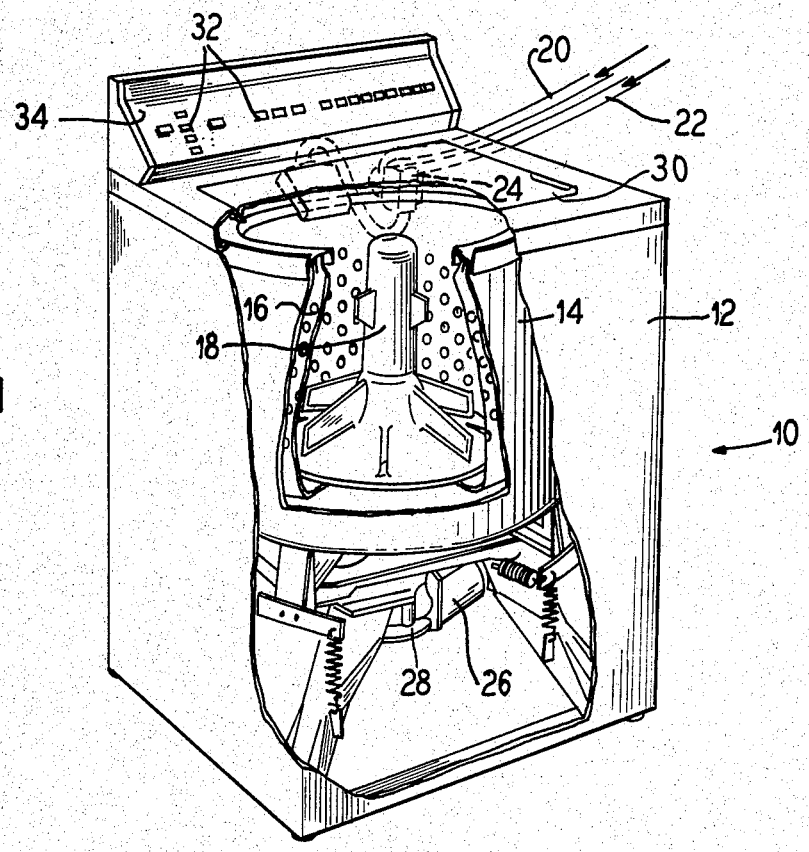
FIG. 1 is a perspective view of an automatic washer embodying the principles of the present invention partially cut away to show the interior mechanism thereof.

In FIG. 1, an automatic washing machine is shown generally at 10 comprising a cabinet or housing 12, and an imperforate tub 14, a concentrically mounted basket 16 with a vertical agitator 18, hot and cold water supplies 20, 22 and an inlet mixing valve 24, an electrically driven motor 26 operably connected via a transmission 28 to the agitator 18 and the basket 16. An openable lid 30 is provided on the top wall of the cabinet for access into the basket 16, and controls 32 including a presettable sequential control means for use in selectively operating the washing machine through a programmed sequence of washing, rinsing and drying steps are provided on a console panel 34.

Figure 2:
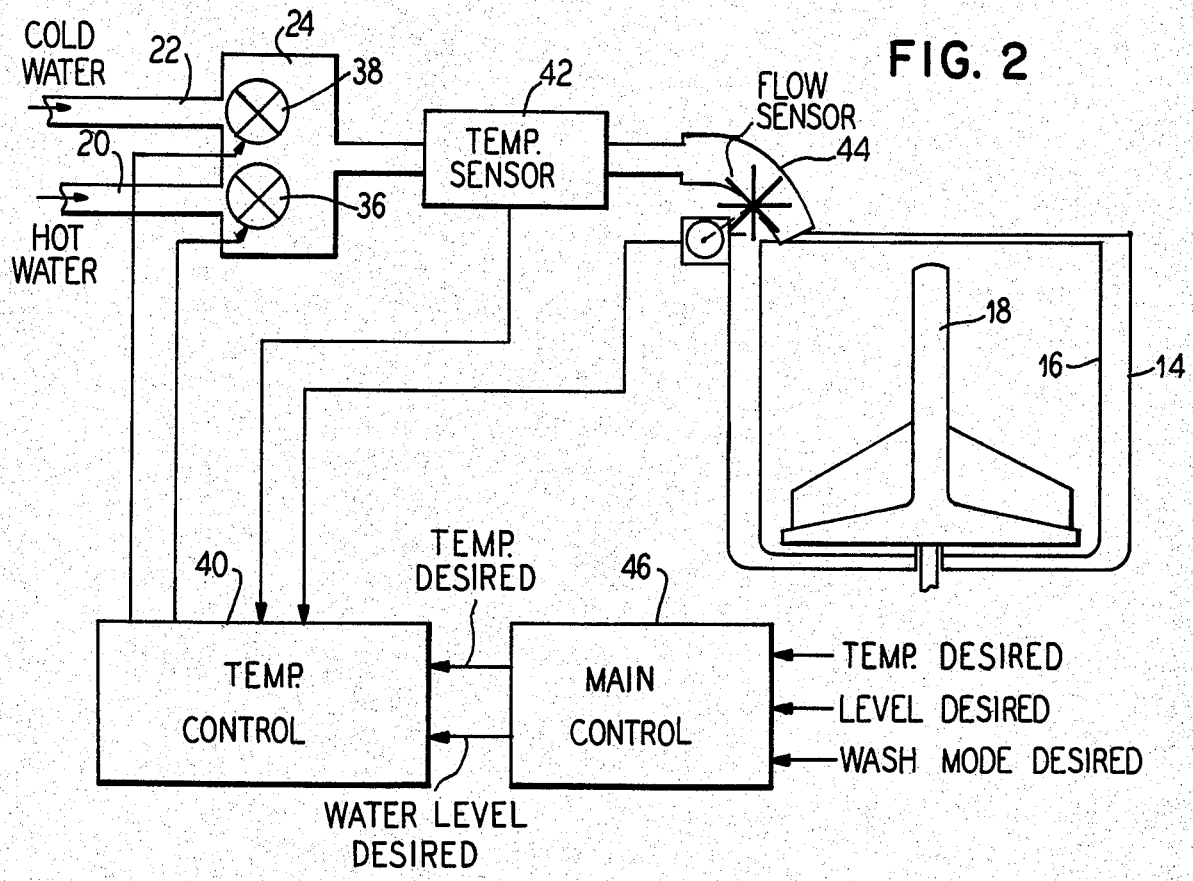
FIG. 2 is a schematic block diagram of the control system of the present invention.

FIG. 2 is a schematic block diagram of the control system of the present invention. The hot water 20 and cold water 22 supply lines are connected to a mixing valve 24 and are controlled by separate valves 36, 38 respectively. The valves 36, 38 are controlled by a temperature control microcomputer 40. A temperature sensor 42 is located downstream of the mixing valve 24 and is used to sense the temperature of the water passing therethrough and to transmit the temperature value to the temperature control microcomputer 40.

Figure 3:
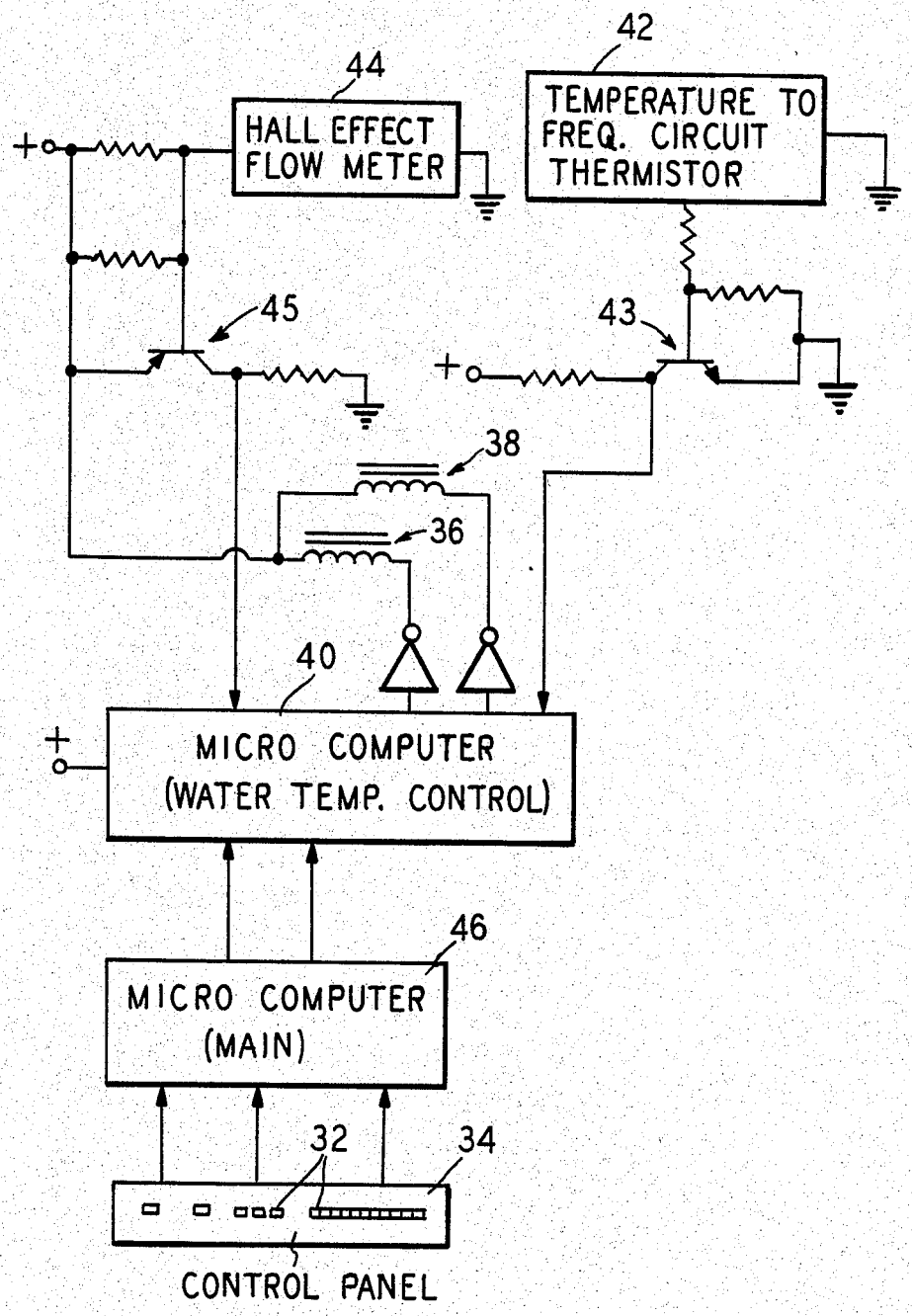
FIG. 3 is a schematic electrical diagram of the control system of the present invention.

FIG. 3 shows an electrical schematic diagram in which the temperature sensor 42, being a known thermistor-type sensor, transmits the sensed temperature value as a voltage to the microcomputer through a standard voltage amplifier 43. A flow sensor 44 is also positioned downstream of the mixing valve 24 to sense the flow of water therethrough and to send the flow value to the temperature control microcomputer 40 (FIG. 2). In FIG. 3, the flow sensor or flow meter 44 is shown as a Hall Effect flow meter which is a well known device. The flow rate value is transmitted as a voltage through a standard voltage amplifier 45 to the microcomputer 40. The incoming water is then directed into the basket 16 as part of the normal fill process (FIG. 2).

Desired water temperature and level parameters are selected by the user and are entered through the appropriate controls 32 on the console 34 which are stored by a main control microcomputer 46 which is shown as a separate microcomputer but could also be a part of the same microcomputer 40. These values are in turn input to the temperature control microcomputer 40. A desired wash mode can also be input into the main control microcomputer 46 by the user.

Figure 4:
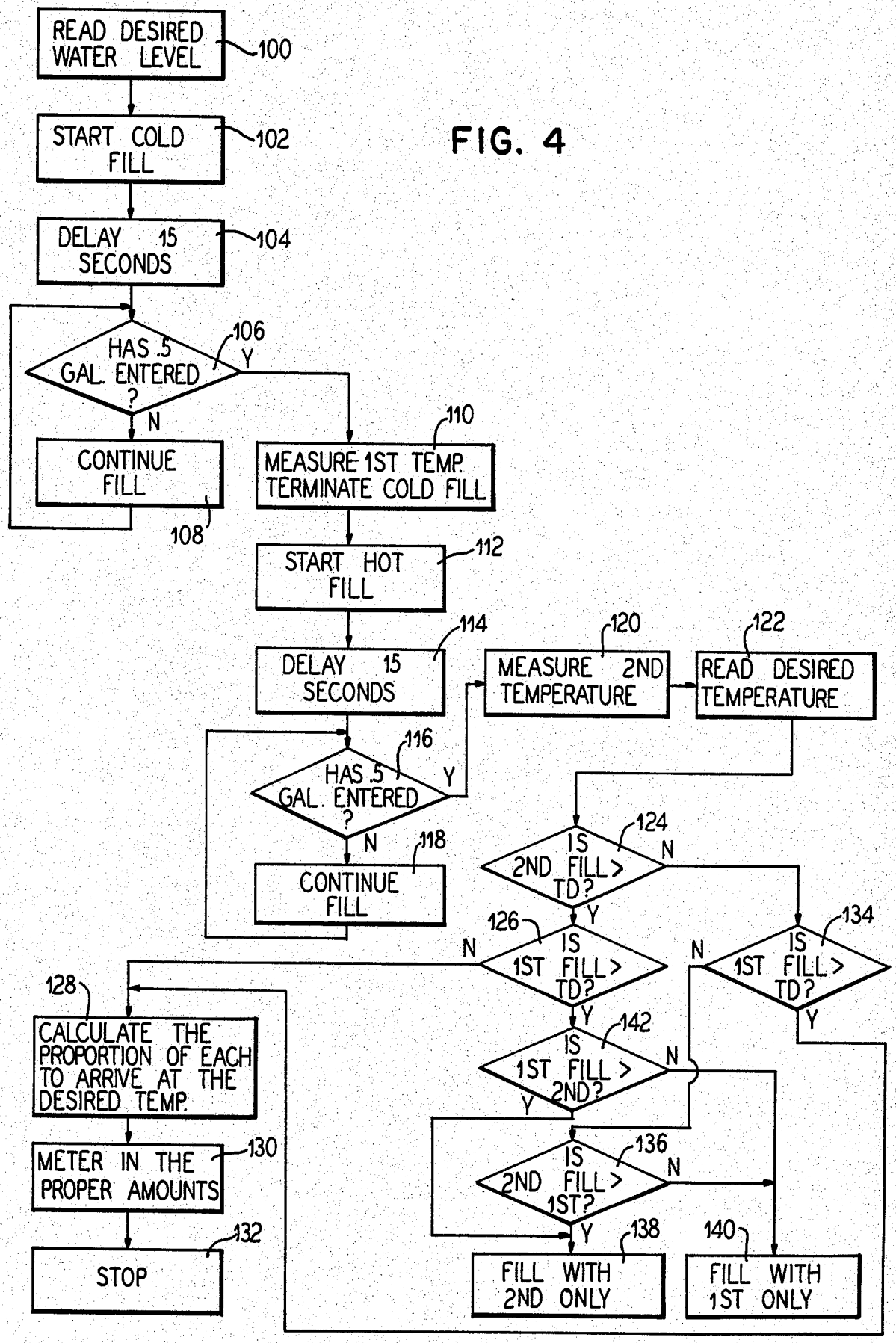
FIG. 4 is a flow chart detailing the steps taken by the control mechanism of the present invention.

FIG. 4 is a flow chart diagram of the steps followed by the control system of the present invention. In control block 100 the desired water level selected by the user through appropriate controls 32 is read and input to the main control microcomputer 46 and the temperature control microcomputer 40. Control then passes to control block 102 which causes the cold water valve 38 to open thereby allowing water from inlet line 22 to flow through the mixing valve 24 past the temperature sensor 42 and the flow sensor 44. Control is then passed to control block 104 for a 15 second delay.

Control passes to control block 106 where an inquiry is made to determine if a predetermined volume, for instance half of a gallon, has flowed through the flow sensor 44. If this volume has not yet flowed through, control is passed to control block 108 which continues the filling process and passes control back to control block 106 to repeat the inquiry until half a gallon has flowed through the flow sensor 44. The half gallon amount is not critical but rather is an amount selected to ensure that a steady state temperature of the incoming water has been attained.

Once control block 106 determines that the predetermined volume has flowed through the flow sensor 44, control is passed to control block 110 which inputs a first flow rate sensed by the flow sensor 44 and a first temperature sensed by the temperature sensor 42 into the temperature control microcomputer 40 and terminates the cold water fill by closing water valve 38. Control is then passed to control block 112 which starts the hot water fill by opening control valve 36 allowing water from inlet line 20 to pass through the mixer valve 24 and through the temperature sensor 42 and flow sensor 44 into the basket 16. Control is then passed to control block 114 which causes a 15 second delay.

After the 15 second delay, control is passed to control block 116 which inquires whether half a gallon of this second inlet water has flowed through the flow sensor 44. If half a gallon has not flowed through, control is passed to control block 118 which continues the fill and returns control to control block 116 until it has been determined that half a gallon has entered. When this is determined, control is passed to control block 120 where a second flow rate is measured by the flow sensor 44 and a second temperature is measured by the temperature sensor 42 and those values are input to the temperature control microcomputer 40. Control is then passed to control block 122 where the desired temperature selected by the user through control buttons 32 is read and input to the main control microcomputer 46 and the temperature microcomputer 40.

Control is then passed to control block 124 which inquires whether the second temperature measured is greater than the selected desired temperature. If the answer to that inquiry is affirmative, control is passed to control block 126 which makes the inquiry of whether the first fill temperature is greater than the desired selected temperature. If the answer to that inquiry is negative, it follows that the desired temperature is between the first and second temperatures and control is passed to control block 128 where the proporation of each inlet water flow is calculated to result in a final water level being at the desired selected temperature. Control is then passed to control block 130 where the temperature control microcomputer operates the hot and cold water valves 36, 38 to meter in the proper amounts of each liquid flow and then control is passed to control block 132 to end this portion of the program.

If the answer to the inquiry in control block 124 is instead negative, control is passed to control block 134 where it is inquired whether the first fill temperature is greater than the selected temperature. If the answer to this inquiry is affirmative, it follows that the desired temperature is between the first and second sensed fill temperatures and control is passed to control block 128 as described above.

If the answer to the inquiry in control block 124 is negative and the answer to the inquiry in control block 134 is also negative, it follows that both fill temperatures are below the desired temperature and control is passed to control block 136 to inquire whether the second fill temperature is greater than the first fill temperature. If the answer to this inquiry is affirmative, control is passed to control block 138 which causes the hot water valve 36 to open since the second water temperature will be closer to the desired temperature than the first fill temperature. However, if the answer to the inquiry in control block 136 is negative, control passes to control block 140 which causes the cold water valve to open, filling the basket with the first liquid since that will be closer in temperature to the desired selected temperature.

If the answer to the inquiry in control block 124 is affirmative and the answer to the inquiry in control block 126 is also affirmative, it follows that both the first and second fill temperatures are greater than the desired temperature and control passes to control block 142 to inquire whether the first fill temperature is greater than the second fill temperature. If the answer to this inquiry is affirmative, control is passed to control block 138 to fill the basket with the second, cooler water which will be closer to the selected desired temperature. However, if the answer to the inquiry in control block 142 is negative, control is passed to control block 140 which will fill the basket with the first, cooler water which is closer to the desired selected temperature.

From the foregoing description it is shown that the control valves 36,38 are each cycled once to determine the temperature of the particular inlet water streams and then after calculating the proportion of each of the streams to be admitted to the washer basket, each valve is cycled open and closed not more than once, if at all. In this manner, the final water temperature will be as close to the desired selected temperature as is possible given the temperatures of the incoming water streams and the cycling of the control valves is held to a maximum of two cycles each. Further, the operation of the mechanism is not affected by which water inlet is connected to which inlet control valve, thereby avoiding any problems of the mechanism selecting the "wrong" control valve to achieve the desired temperature if the hot and cold water hookups are reversed.

As is apparent from the foregoing specification, the invention is susceptible of being embodied with various alterations and modifications which may differ particularly from those that have been described in the preceeding specification and description. It should be understood that we wish to embody within the scope of the patent warranted hereon all such modifications as reasonably and properly come within the scope of our contribution to the art.

The embodiment of the invention in which an exclusive property or privilege is claimed are defined as follows:

1. An automatic washing machine having a tub to receive a load of clothes to be washed including an automatic liquid temperature control system comprising:

means for selecting a desired final temperature of the wash liquid in said tub, means for selecting a desired final liquid level in said tub, first valve means for admitting a first liquid into said tub, second valve means for independently admitting a second liquid into said tub, means for measuring the temperature of each liquid entering said tub, means for measuring the flow rate of each liquid entering said tub, means for calculating the volume of said first liquid and second liquid required to result in filling said tub to said preselected liquid level at said preselected temperature based on said measured temperatures and flow rates, means for opening said first and second valve means for a time sufficient to admit said calculated volumes based on said measured flow rates, whereby said valves are cycled no more than once for measuring said temperature and flow rates and once for admitting said calculated volumes.

2. The device of claim 1, wherein said means for selecting a desired final temperature comprise user operable controls on said washing machine.

3. The device of claim 1, wherein said means for selecting a desired final liquid level comprise user operable controls on said automatic washing machine.

4. The device of claim 1, wherein said means for measuring the temperature comprises a temperature sensor between said liquid admitting means and said tub.

5. The device of claim 1, wherein said means for measuring the flow rate comprises a flow sensor through which said liquid passes prior to entering said tub.

6. A method of controlling the temperature of liquid in a liquid treatment machine comprising:

selecting a desired final temperature of a liquid in a liquid container in the machine, selecting a desired final liquid level in the liquid container, admitting a first liquid into the container, measuring the temperature of the first liquid admitted into the container, measuring the flow rate of the first liquid entering the container, admitting a second liquid into the container, measuring the temperature of the second liquid entering the container, measuring the flow rate of the second liquid entering the container, determining the volume of the first liquid and the second liquid required to result in filling the container to the preselected liquid level at the preselected temperature based on said measured temperatures and flow rates, and admitting the determined volumes of the two liquid to the container.

7. A control system for admitting precise amounts of two separate temperature distinct liquid streams into a container to result in a preselected final liquid volume parameter at a selected final temperature parameter comprising:

means for selecting said final liquid volume parameter;

means for selecting said final temperature parameter;

means for independently admitting liquid from two separate sources into said container;

means for measuring and storing the temperature and flow rate of each of said liquid streams; and means for calculating the volume of each of said liquids required to arrive at said preselected parameters based on said measured temperatures and flow rates.

* * * * *